US005833272A

United States Patent [19]

Schou

[11] Patent Number: 5,833,272

[45] Date of Patent: Nov. 10, 1998

[54] ADVERTISING DISPLAY AND CABLE STATION CONVERSION CHART FOR TELEVISION REMOTE CONTROLS

[76] Inventor: Linda C. Schou, 29308 Regent's Pointe, Farmington Hills, Mich. 48331

[21] Appl. No.: 795,094

[22] Filed: Feb. 5, 1997

Related U.S. Application Data

[60] Provisional application No. 60/011,228 Feb. 6, 1996.

[51] Int. Cl. [6] ..... B42D 15/00

[52] U.S. Cl. ..... 283/115; 283/56

[58] Field of Search ..... 283/115, 64, 65, 283/56, 117, 2, 101, 66.1

[56] References Cited

U.S. PATENT DOCUMENTS

| | | | |
|---|---|---|---|
| 5,217,259 | 6/1993 | Wilen | 293/115 X |
| 5,263,744 | 11/1993 | Linden | 283/115 |
| 5,419,586 | 5/1995 | Golson | 283/115 X |
| 5,429,390 | 7/1995 | King | 283/115 X |
| 5,458,376 | 10/1995 | Biewald | 283/115 X |

*Primary Examiner*—Willmon Fridie, Jr.
*Attorney, Agent, or Firm*—John R. Benifiel, Esq.

[57] ABSTRACT

An advertising-television conversion chart display is detachably attached to the rear of a television remote control with a pressure sensitive adhesive or other means. The display is multileaf, having a series of panels, the outer surface of a cover panel imprinted with advertising, the inner surfaces of panels imprinted with a conversion chart. Various forms of panel connections are disclosed, as well as attachments and securements from the panels.

12 Claims, 2 Drawing Sheets

ADVERTISING DISPLAY AND CABLE STATION CONVERSION CHART FOR TELEVISION REMOTE CONTROLS

CROSS-REFERENCE TO RELATED APPLICATION

This application claims the benefit of provisional application U.S. Ser. No. 60/011,228, filed on Feb. 6, 1996.

BACKGROUND OF THE INVENTION

This invention concerns display charts and more particularly charts for cross referencing cable or satellite channel designations to broadcast stations channel designations or other descriptive designations, i.e., networks, movie channels, etc.

Television viewers often desire to know the station channel number or other designation corresponding to a cable or satellite channel designation. This usually requires looking through voluminous guide publications. There have heretofore been provided simple, limited stick-on charts provided for mounting on a remote control device (television remote control) which service this purpose.

The object of the present invention is to provide a more comprehensive conversion chart display for mounting on television remote controls, which display also serves another purpose.

SUMMARY OF THE INVENTION

The above-recited object of the present invention comprises a multileaf conversion chart-advertising or promotional display of a size attachable to the rear surface of a television remote control, preferably so as to be readily detachable. At least one panel carries an advertising display, and one or more other panels carry a conversion chart displaying the correspondence between channel designations of cable or satellite provides to television broadcast channel designations, network designations, or other designations, i.e., HBO™, Showtime™, etc.

The backside of the multileaf display may be attached to the television remote control by releasable pressure sensitive adhesive, Velcro™ patches, or magnetic holders.

Various multileaf constructions are possible, including a flip-up folded panel construction forming a cover, imprinted with advertising promotional material, and the conversion chart imprinted on the inside of the cover and the facing panel exposed when the cover is opened. The cover can be held closed by a tab, adhesive, etc.

The multileaf display can also take the form of top or side hinged panels, accordion foldout panels, flip panels connected in one corner, or three-part foldup and folddown panels.

A rotary cover disc with a slot window associated with a fixed disc imprinted with charts can be used for more extensive conversion listings.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
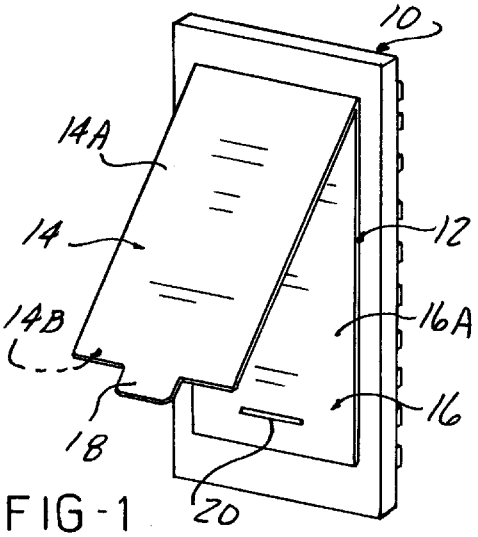
FIG. 1 is a perspective view of a television remote control having a multileaf display according to the invention attached to the rear of the television remote control.

The multileaf cable-to-broadcast designation cross-reference chart and advertising display 12 according to the present invention is of a size adapted to be detachably mounted to the backside of a typical television remote control 10 (FIG. 1), i.e., is rectangular and several inches long, by one or two inches wide. The chart 12 consists of a foldup cover panel 14 attached to an inside panel 16 along a fold line. The outside surface 14A of the cover panel 14 bears advertising copy, company logos, or other promotional material. The chart and advertising can be updated by periodic replacement of the display 12.

When opened, a cable-to-station designation cross-reference or conversion chart can be viewed, printed on facing surface 16A and the reverse side of the cover 14A. A company name/logo can also be printed on these panels along with the chart.

The reverse side 16B of the inside panel 16 has a patch of pressure sensitive releasable adhesive 52B applied to the upper section (FIG. 11), allowing ready attachment to the back of the television remote control 10 while being readily detachable. The adhesive attachment patch can be in the form of a piece of double-sided adhesive tape.

A tab 18 on the cover panel 14 is able to be inserted in a slot 20 in the inside panel 16 to hold the cover 14 closed.

Figure 2:
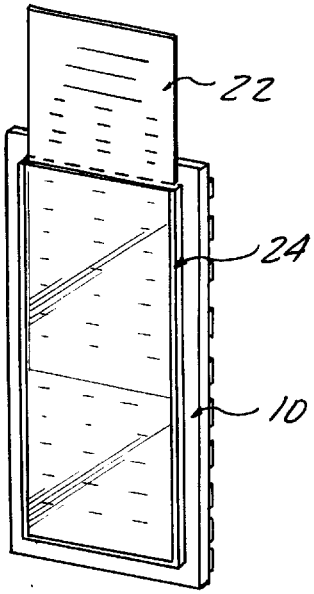
FIG. 2 is a perspective rear view of a television remote control having a second embodiment of the display according to the invention attached thereto.

FIG. 2 shows a slidable version in which a cover panel 22 is slidable in a transparent plastic jacket-holder 24 attached to the television remote control 10.

Figure 3:
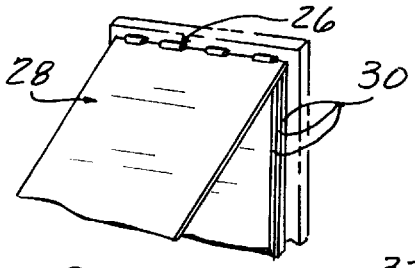
FIG. 3 is a fragmentary perspective view of a third embodiment of the display shown attached to a television remote control, shown in phantom.

FIG. 3 shows a spiral wound hinge attachment 26 of the top of a cover 28, allowing for a plurality of inside panels 30. The hinge 26 can also allow ready replacement of individual panels.

Figure 4:
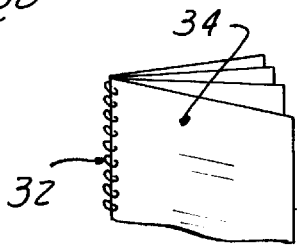
FIG. 4 is a fragmentary perspective view of a fourth embodiment of the display according to the present invention.

FIG. 4 shows an alternate side hinging attachment 32 of a cover 34.

Figure 5:
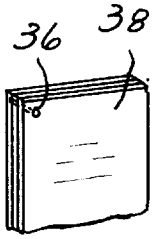
FIG. 5 is a fragmentary perspective view of a fifth embodiment of the display according to the present invention.

FIG. 5 shows a single point attachment 36 at an upper corner of the display 38.

Figure 6:
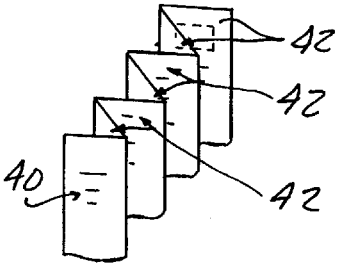
FIG. 6 is a fragmentary perspective view of a sixth embodiment of the display according to the present invention.

FIG. 6 shows an accordion-pleat configuration of a cover 42 in which a series of inside panels 42 are connected along fold lines on each side alternately.

Figure 7:
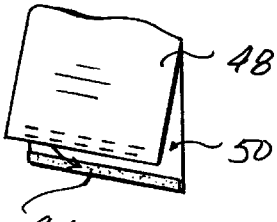
FIGS. 7 and 8 are fragmentary perspective view of the display shown in FIG. 1 with alternate cover retention features.
Figure 8:
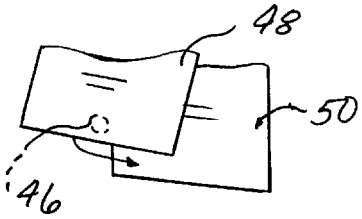

An adhesive strip 44 or magnetic patch 46 can be used to hold the cover 48 closed over the inside panel 50, as seen in FIGS. 7 and 8.

Figure 9:
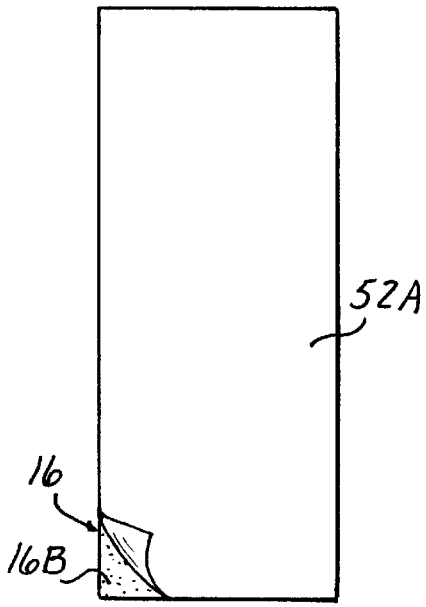
FIG. 9 is a rear view of the display shown in FIG. 1, with a first form of the attachment therefor.
Figure 10:
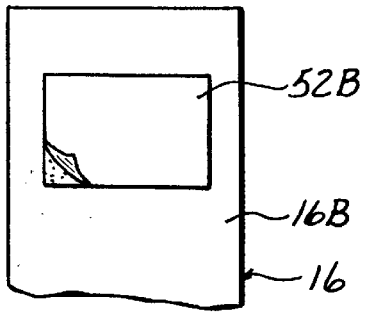
FIG. 10 is a rear view of the display shown in FIG. 1, with a second form of the attachment therefor.

A peelable paper cover layer 52A, 52B can overlie the exposed side of the adhesive tape on the back of inside panel 16B for convenient handling prior to mounting (FIGS. 9, 10).

Figure 11:
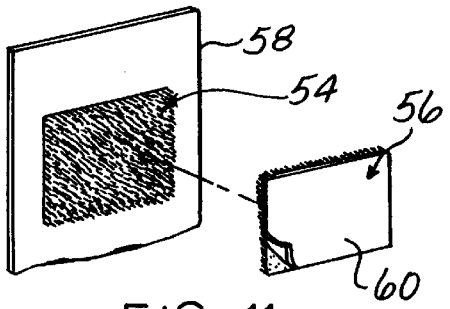
FIG. 11 is a rear view of the display shown in FIG. 1, with a third form of the attachment therefor.

FIG. 11 shows VELCRO™ patches 54, 56 which can be used for releasable attachment of a chart panel 58 to a television remote control. A peelable cover layer 60 overlying an adhesive coating is on the backside of each patch 54, 56.

Figure 12:
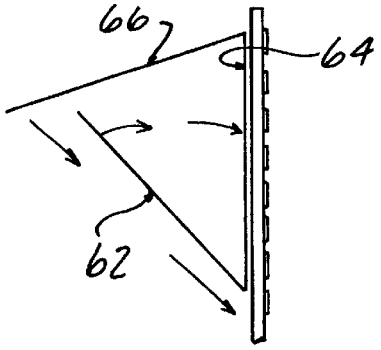
FIG. 12 is a side view of a television remote control with a seventh embodiment of the display according to the invention attached thereto.

FIG. 12 shows an additional inside panel 62 hinged to the bottom of a first inside panel 64, a cover 66 hinged to the top side of the first inside panel 64 allowing fold out viewing of a chart imprinted on the inside of the cover 66 and additional panel 62, as well as the outside of the first inside panel 64.

The additional inside panel 64 could also be imprinted with several product coupons and be perforated along the fold line to be detachable.

Figure 13:
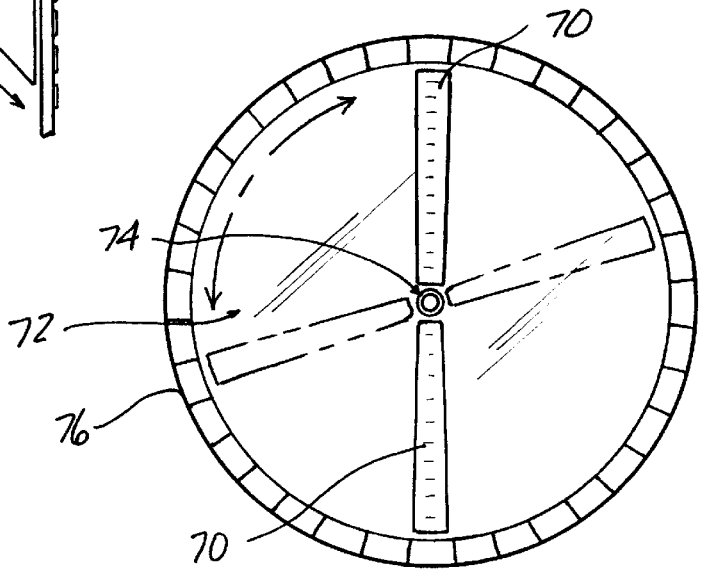
FIG. 13 is a plan view of an embodiment of a display according to the invention.

FIG. 13 shows a rotary form where slots 70 in a cover disc 72 pivoted at 74 allowing viewing of a chart imprinted on a fixed disc 76 attached to the remote.

The leaves or panels of the display are constructed of medium-weight paper cards measuring 7.5" by 1.875", center folded horizontally, with die cut of either box-top design or half moon design to provide closure. Coated paper or cardboard or plastic can also be employed. The panels are preferably printed in color. The panels could also be silk-screened, embossed, stencilled, etc.

I claim:

1. A combined advertising and channel designation cross-reference chart display comprising:

a multileaf series of panels of sheet material overlying one another so as to allow viewing a surface of each panel when each overlying panel is moved away from said overlying position, including a cover Panel and an inside panel;

hinging means connecting said cover panel and said inside panel together along one side;

an outer surface of said cover panel imprinted with advertising material;

said inside panel having a surface imprinted with a channel designation cross-reference chart; and, attachment means for attaching a rear surface of said inside panel of said display to the rear of a television remote control.

2. The display according to claim 1 wherein said cover panel is hinged along a top side to said inside panel by said hinging means to be foldable down over said inside panel surface.

3. The display according to claim 2 wherein said cover panel has an inside surface imprinted with a portion of a television channel conversion chart, said surface of said inside panel imprinted with a remaining portion of said chart.

4. The display according to claim 3, 4 wherein said hinging means comprises a spiral hinge attaching said panels together along said one side.

5. The display according to claim 1 wherein said multileaf series of panels includes a plurality of inside panels, and wherein each of said panels are attached together along fold lines comprising said hinging means, said fold lines on alternating sides of said panels to form an accordion pleat arrangement.

6. The display according to claim 1 wherein said cover panel is securable in a closed position over said inside panel surface with a securement feature.

7. The display according to claim 1 wherein said attachment means comprises a pressure sensitive adhesive coating on a rear surface of said rear panel.

8. The display according to claim 3 further including an intermediate panel foldable up to form a bottom edge of said inside panel and having said rear panel folded down over both said inside and intermediate panels.

9. The display according to claim 8 wherein said intermediate panel is imprinted with coupons and is perforated to be detachable from said inside panel.

10. The display according to claim 8 wherein a portion of a television conversion chart is imprinted on said intermediate panel.

11. A combined advertising and channel designation cross-reference chart display comprising:

a base disc having an array of radially extending channel designation cross reference charts imprinted on an upper surface thereof;

a cover disc overlying and in alignment with said base disc and having imprinted advertising material thereon, said cover disc being pivoted to said base disc and having a slot successively exposing each of said channel designation cross reference charts in said array on said base disc as said cover disc is rotated;

attachment means for attaching a rear surface of said base disc panel of said display to the rear of a television remote control.

12. A combined advertising and channel designation cross-reference chart display comprising:

a stack of sheet material panels;

a holder piece into which said stack of panels are inserted;

an outer surface of said holder imprinted with advertising material;

said panels each having a surface imprinted with a channel designation cross-reference chart; and, attachment means for attaching a rear surface of said holder piece to the rear of a television remote control.

* * * * *

UNITED STATES PATENT AND TRADEMARK OFFICE

CERTIFICATE OF CORRECTION

PATENT NO. : 5,833,272

DATED : November 10, 1998

INVENTOR(S) : Linda C. Schou

It is certified that error appears in the above-indentified patent and that said Letters Patent is hereby corrected as shown below:

Column 4, line 6, delete "4".

Signed and Sealed this

Eighteenth Day of May, 1999

*Attest:*

*Attesting Officer*

Q. TODD DICKINSON

*Acting Commissioner of Patents and Trademarks*